US005657980A

United States Patent [19]

Cargill et al.

[11] Patent Number: 5,657,980

[45] Date of Patent: Aug. 19, 1997

[54] SORTING FEED MECHANISM

[76] Inventors: N. Allen Cargill, 1131 Tollhouse Rd.; Chester J. Koenig, 928 Catalpa Rd., both of Warminster, Pa. 18974

[21] Appl. No.: 513,913

[22] PCT Filed: Mar. 9, 1994

[86] PCT No.: PCT/US94/02481

§ 371 Date: Sep. 8, 1995

§ 102(e) Date: Sep. 8, 1995

[87] PCT Pub. No.: WO94/20398

PCT Pub. Date: Sep. 15, 1994

Related U.S. Application Data

[63] Continuation of Ser. No. 29,111, Mar. 10, 1993, abandoned.

[51] Int. Cl.[6] ..... B65H 83/00

[52] U.S. Cl. ..... 271/3.05; 271/9.13; 271/270; 271/297; 271/198; 271/300; 271/305

[58] Field of Search ..... 271/3.01, 3.03, 271/3.05, 9.13, 270, 297, 198, 300, 304, 305; 209/534

[56] References Cited

U.S. PATENT DOCUMENTS

| | | | |
|---|---|---|---|
| 3,339,705 | 9/1967 | Burkhardt et al. | 271/184 |
| 3,472,506 | 10/1969 | Rabinow et al. | 371/304 |
| 4,216,952 | 8/1980 | McInerny | 271/10 |
| 4,405,122 | 9/1983 | Faltin | 271/10 |
| 4,420,153 | 12/1983 | Winkler et al. | 271/304 |
| 4,465,192 | 8/1984 | Ohba | 271/3.1 |
| 4,500,084 | 2/1985 | McInerny | 271/35 |
| 4,691,910 | 9/1987 | Cargill | 271/3 |
| 4,805,894 | 2/1989 | Scherer et al. | 271/305 |
| 5,088,722 | 2/1992 | Olexy | 271/304 |
| 5,234,211 | 8/1993 | Olexy | 271/304 |

*Primary Examiner*—H. Grant Skaggs

*Attorney, Agent, or Firm*—John F. A. Earley; John F. A. Earley, III

[57] ABSTRACT

A document sorter for a document dispenser comprises a feeding apparatus for feeding documents to a document feed path, a conveyance apparatus mounted along the document feed path for conveying documents along the document feed path, and a directing apparatus mounted across the document feed path at a 90° angle to the feed path for selectively directing documents along the feed path or for selectively directing documents from the feed path into a selected bin of the document dispenser. The directing apparatus includes a plurality of rotatable selector rotors mounted across the document feed path at a 900° angle to the document feed path, and a D.C. motor for driving each selector rotor in a clockwise direction or a counter-clockwise direction of rotation, as desired.

19 Claims, 7 Drawing Sheets

SORTING FEED MECHANISM

This patent application is a continuation of U.S. patent application Ser. No. 08/029,111, filed Mar. 10, 1993, now abandoned.

BACKGROUND OF THE INVENTION

1. Field of the Invention

This invention relates to automatic document dispensing machines, such as teller-assist cash dispensers, for dispensing documents such as paper money, and particularly concerns a sorting feed mechanism for refilling the dispensing bins of an automatic document dispensing machine.

2. Description of the Prior Art

Document dispensers are in common use today to feed documents, such as paper money, from one or more hoppers or bins to a user. One example, as illustrated by U.S. Pat. No. 4,691,910, which is incorporated herein by reference, is a document dispenser manufactured and distributed by Technitrol, Inc. This document dispenser is used primarily for dispensing paper money in the United States and other parts of the world. This document dispenser has one to six bins for holding one to six stacks of notes of the same or different denominations ready for dispensing in selected number and order to a user. Each bin, which holds up to 500 notes, is filled by an operator. Generally, the operator is a bank teller who must handle large amounts of money.

While the operator must be able to fill and replenish the supply of currency in the cash dispenser, it is desirable to prevent an operator from gaining access to the complete contents of the cash dispenser, which then becomes a more secure document feed device. Consequently, losses from theft may be minimized and time spent counting the contents of the dispensing machine may be reduced. Other uses for a secure document feed device include use in supermarkets by point-of-sale cashiers who must handle large amounts of money, and use in convenience stores where it is desirable to keep the amount of money on hand at a minimum to reduce the likelihood of thefts and robberies and to reduce losses from thefts and robberies.

The prior art is replete with devices for selecting documents by their identification or denomination and transporting a document to a particular storage bin. Among others, devices having solenoid controlled levers are used to divert documents into a selected bin.

However, one of the problems encountered by document dispensing machines is misfeeding, hesitating, or jamming of documents as they are being transported to a selected bin. For example, in check sorters using a lever to direct documents into a bin, contact between the document and the lever causes the documents which contact the lever to slow down which leads to documents piling up, jamming, and misfeeding, thereby limiting the sorting mechanism's rate of processing documents.

Winkler et al. U.S. Pat. No. 4,420,153, issued Dec. 13, 1983, discloses a document handling counting and examining device incorporating high speed rotary gating means. The device of Winkler et al. requires complex circuitry as shown in FIGS. 2–29 of Horvath et al. U.S. Pat. No. 4,381,447, issued on Apr. 26, 1983, which is owned by the assignee of Winkler et al. U.S. Pat. No. 4,420,153. As shown in FIG. 1 of Winkler et al. U.S. Pat. No. 4,420,153, sheets are directed by gating roller 250 into directions including runs 194A and 196A of O-rings 194 and 196 from path 290. This complex mechanical arrangement and corresponding circuitry complicates the Winkler et al. device thereby increasing expenses of construction and operation. Further, the likelihood of sheets jamming is high in such a device having a complex, multi-directional document deflection or gating mechanism. Moreover, the physical configuration of the device of Winkler et al. does not lend itself to use as a sorter device for refilling the dispensing bins of an automatic document dispensing machine. The reason for this is that it is necessary that the refill mechanism fit into a flat horizontal volume above the dispensing bins with documents being fed along a horizontal path. The device of Winkler et al. must be configured in a vertical arrangement with documents feeding down from above, to be used to refill an automatic dispensing machine of the type represented with the present invention.

SUMMARY OF THE INVENTION

It is an object of the invention to provide a document dispenser with a document sorter that allows for filling of the document dispenser without gaining access to the complete contents of the document dispenser.

Another object of the invention is to reduce the likelihood of jamming of documents as they are being fed into the bins of the document dispenser.

These and other objects are accomplished by providing a document dispenser with a document sorter that comprises feeding means for feeding documents to a document feed path, conveyance means mounted along the document feed path for conveying documents along the document feed path, directing means mounted across the document feed path at a 90° angle to the feed path for selectively directing documents along the feed path or for selectively directing documents from the feed path, said direction means including a plurality of rotatable selector rotors mounted across the document feed path at a 90° angle to the document feed path, and means for driving each selector rotor and for selectively controlling the direction of rotation of each selector rotor.

The invention includes selector rotors, one for each bin of the document dispenser, placed across the document feed path of the documents being fed into the document dispenser. Each rotor is turned in either direction of rotation by a direct current motor, which requires a simple voltage polarity change to alter direction. Each document travels along the document feed path and encounters a first selector rotor. If it is desired to deposit the document in the bin associated with the first selector rotor, the first selector rotor spins in a direction that directs the document into the bin. If the document is to be deposited in a bin other than the first bin, the first selector rotor spins in the reverse direction to direct the document further along the document feed path, where the document encounters a second selector rotor, the spinning direction of which determines whether the document is deposited in the second bin or directed farther along the document feed path. This is repeated for each subsequent selector rotor, until the last selector rotor is reached. The last selector rotor rotates in a direction to direct any documents reaching it into the last bin.

DETAILED DESCRIPTION OF THE DRAWINGS

Figure 1:
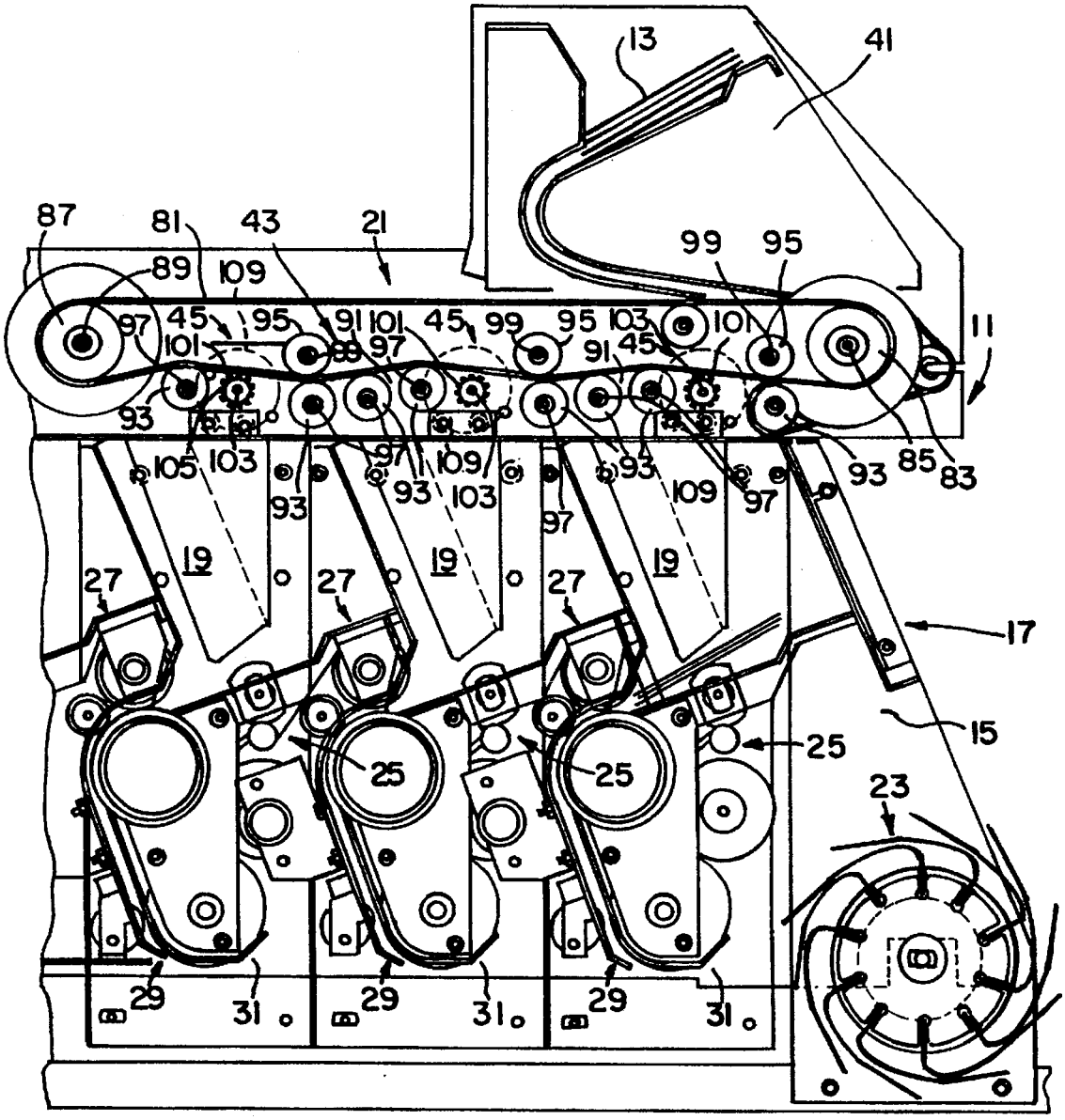
FIG. 1 is a view in cross section of a document dispenser having a document sorter, constructed in accordance with the invention.

Turning now to the drawings, there is shown in FIG. 1 a document dispenser 11 for dispensing documents 13 such as paper currency, which comprises a frame 15, a dispensing apparatus 17 mounted on frame 15 which includes a plurality of bins 19 for holding stacks of documents 13, and a document sorter 21 mounted on frame 15 above the dispensing apparatus 17 for sorting documents 13 into selected bins 19. For illustrative purposes, a document dispenser 11 having three bins 19 is shown. However, the document dispenser 11 may have two or more bins 19, as desired.

Dispensing apparatus 17 is disclosed in Cargill et al. U.S. Pat. No. 4,691,910, issued on Sep. 8, 1987, and owned by Technitrol, Inc., said patent being incorporated herein by reference.

The dispensing apparatus 17 includes stacker means 23 mounted on frame 15 for receiving successively fed documents and stacking them. Bins 19 are mounted on frame 15 and hold stacks of documents 13. Stacker feeding means 25 is associated with each bin 19 and each stacker feeding means 25 is mounted on frame 15 for feeding documents from the bins 19 to the stacker means 23.

The stacker feeding means 25 includes document feeding and separating means 27 for feeding documents from each bin 19 so the documents 13 move individually in a successive condition from each bin 19, document acceleration means 29 associated with each document feeding and separating means 27 and mounted on frame 15 for providing a space between successively fed documents 13, and document delivery means 31 mounted on frame 15 for feeding the spaced apart documents 13 to the stacker means 23.

Document feeding and separating means 27 is substantially the same as the apparatus described in detail in McInerny U.S. Pat. No. 4,500,084, which issued on Jul. 27, 1983, which is incorporated herein by reference, and which is owned by Technitrol, Inc.

The document sorter 21 is mounted on frame 15 above bins 19 and sorts documents 13 into a selected bin 19, as desired. Document sorter 21 includes feeding means 41, conveyance means 43, and directing means 45.

Feeding means 41 is illustrated schematically in FIG. 1. Feeding means 41 may be the mechanism of stacker feeding means 17, said mechanism being mounted on frame 15 adjacent to conveyance means 43 so as to provide documents 13 in a successive condition to conveyance means 43. Feeding means 41 also may be the apparatus shown in U.S. Pat. Nos. 4,216,952, 4,416,449, or 4,500,084, all incorporated herein by reference, among others. The feeding means 41 optionally may include a document size detection apparatus and a counterfeit detection apparatus.

Alternatively, feeding means 41 may simply be a plate positioned adjacent conveyance means 43 to permit feeding of documents one by one by hand.

Conveyance means 43 is mounted on frame 15 below feeding means 41 and is adapted to receive documents 13 from feeding means 41. Conveyance means 43 includes a drive belt 81 mounted between pulley 83 mounted on shaft 85 that is secured to frame 15 and pulley 87 mounted on shaft 89 that is secured to frame 15. Drive belt 81 is driven by pulley 83 using a motor (not shown), and drive belt 81 has a lower run that extends along a document feed path 91. Conveyance means 43 extends in a substantially horizontal plane above bins 19.

A plurality of idler wheels 93 and 95 are positioned along the document feed path 91 in contact with the lower run of the drive belt 81.

Idler wheels 93, which are free-wheeling on shafts 97 mounted on frame 15, are provided to press each document 13 against the lower run of drive belt 81 as each document 13 moves along the document feed path 91. Idler wheels 93 are spaced such that each document 13 is never in free flight along the document feed path 91 until the document 13 reaches the bin 19 that has been selected.

Idler wheels 95, which are free-wheeling on shafts 99 mounted on frame 15, are positioned to provide tautness to the drive belt 81 to ensure contact between the drive belt 81 and the idler wheels 93.

The idler wheels 93, 95 located just before each selector rotor 101 are in the position to direct the leading edge of document 13 to the midsection of the selector rotor 101 and are close enough to selector rotor 101 that the beam strength of document 13 is still supported.

Directing means 45 is associated with each bin 19 and is mounted across the document feed path 91 at a 90° angle to the document feed path 91 for selectively directing documents 13 along the document feed path 91 or for selectively directing documents 13 from the document feed path 91. The directing means 45 has a plurality of rotatably selector rotors 101 mounted across the document feed path 91 at a 90° angle to the document feed path 91 on shafts 103 that are mounted on frame 15.

Figure 9:
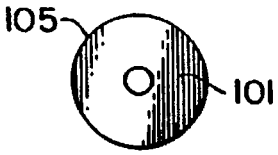
FIG. 9 is a view in cross section of one embodiment of a selector rotor constructed in accordance with the invention.

Preferably, the surface 105 of each selector rotor 101 is made of foam rubber and has a circular cross-section, as shown in FIG. 9. However, surface 105 may be made of other materials, especially materials having a high friction surface or being indentable.

Figure 5:
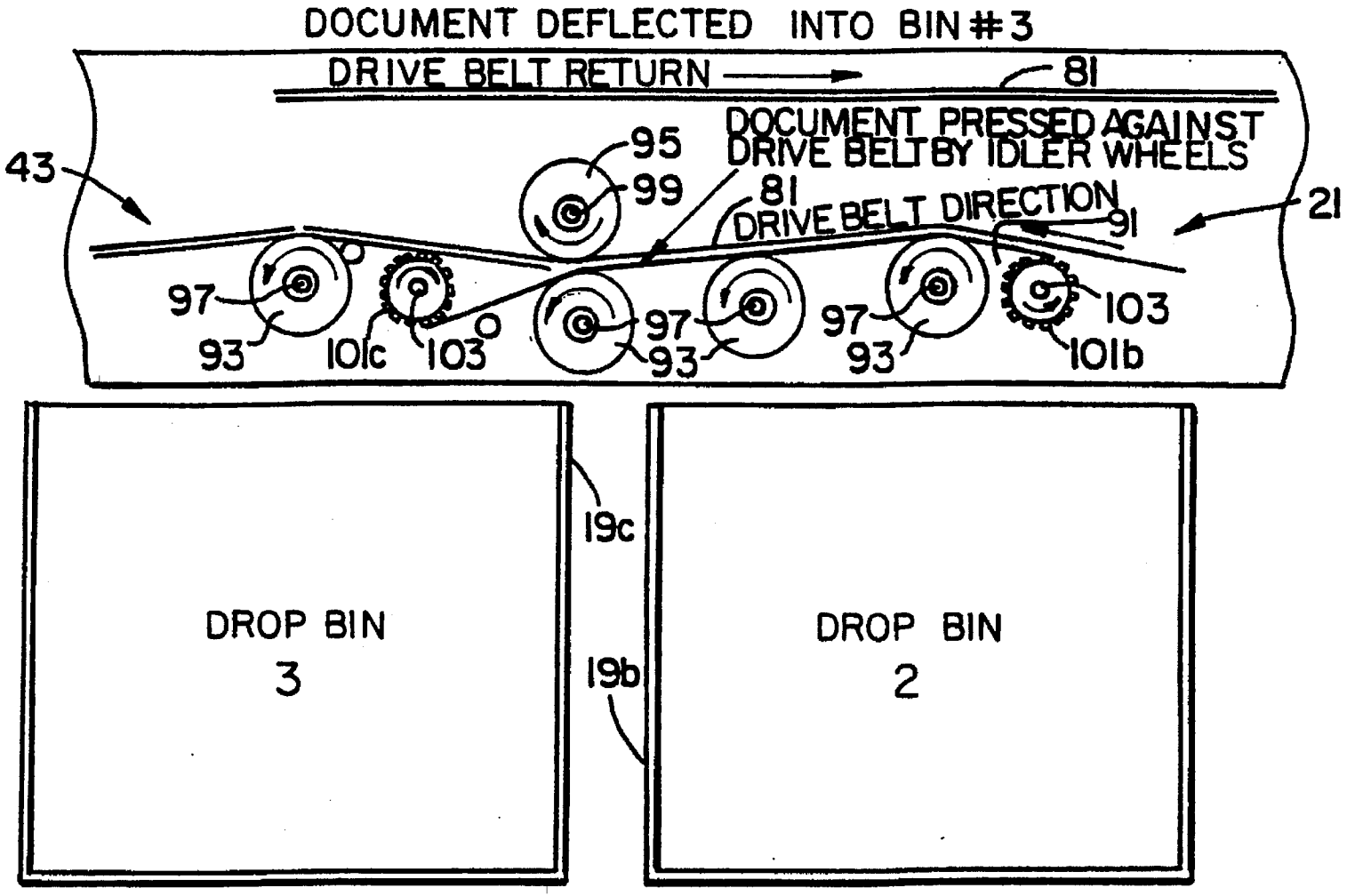
Figure 6:
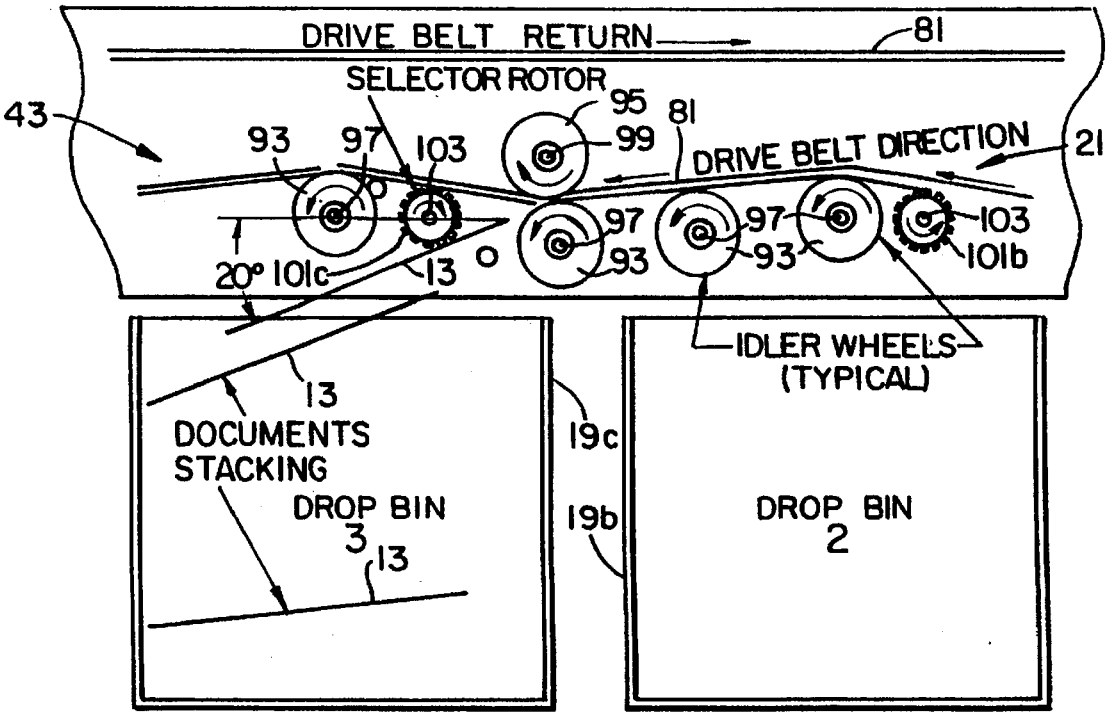
Figure 8:
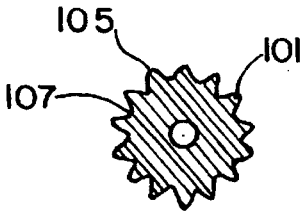
FIG. 8 is a view in cross section taken along the lines and arrows 8—8 shown in FIG. 7.
Figure 7:
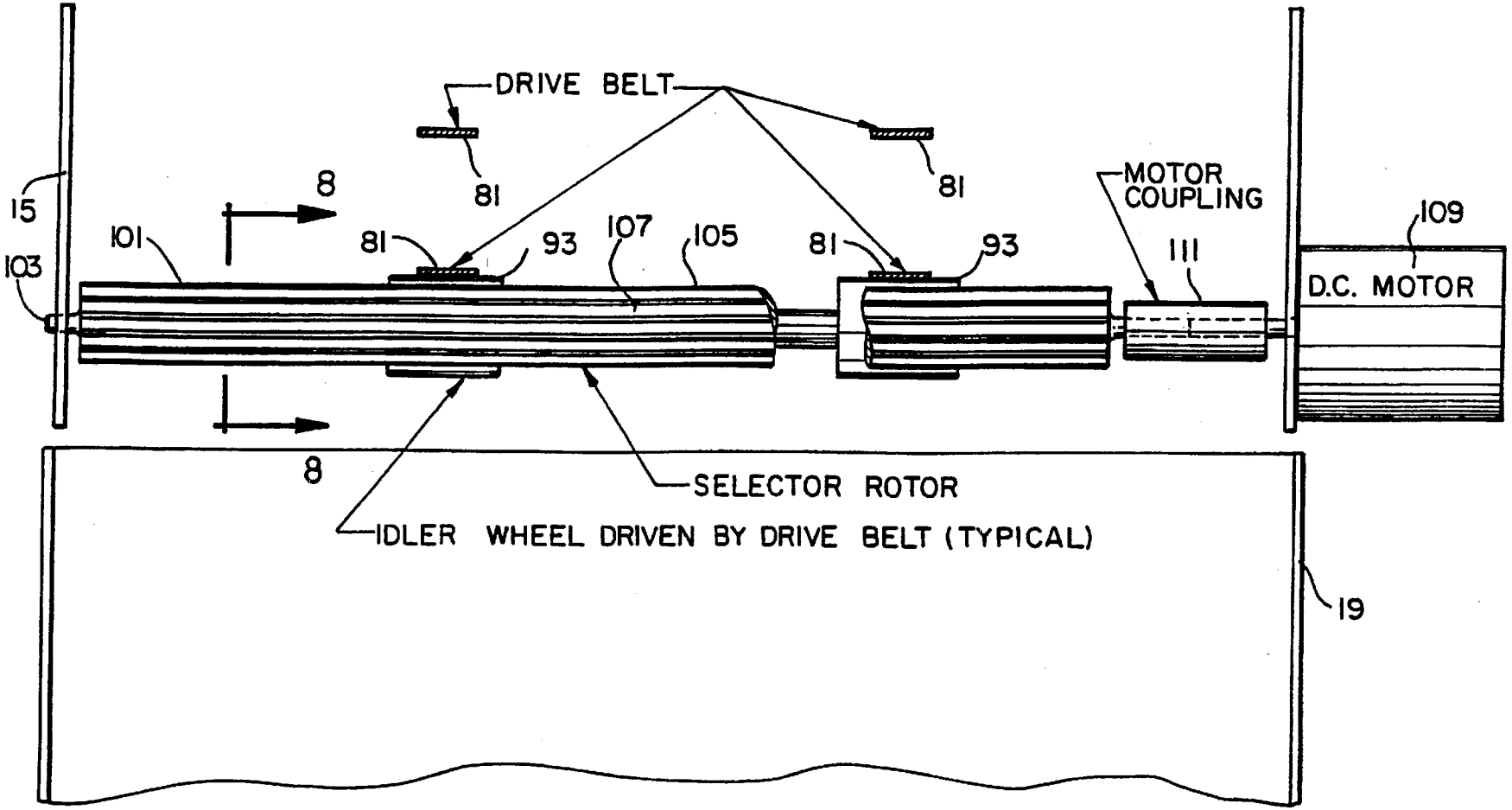
FIG. 7 is a view in elevation taken along the lines and arrows 7—7 shown in FIG. 4.

Alternatively, as shown in detail in FIG. 7, each selector rotor 101 has a surface 105 that has grooves 107 formed in it. The grooves 107 extend across each selector rotor 101 in a direction parallel to the axis of the selector rotor 101. As shown in FIGS. 1–6, and 8, each selector rotor 101 has a gear-shaped cross section.

As shown in detail in FIG. 7, each selector rotor 101 is driven by a D.C. motor 109 mounted on frame 15. Each shaft 103, onto which a selector rotor is mounted, is connected to a D.C. motor 109 via a motor coupling 111. Each D.C. motor 109 is connected to and controlled by a computer control apparatus (not shown) of the document dispenser 11. Accordingly, signals from the computer control center determine the direction of rotation of the selector rotors 101, thereby controlling into which bin 19 each document 13 will be deposited. If the selector rotor 101 is spinning in a counterclockwise direction, the document 13 engaging it will be directed to continue to move along the document feed path 91. If the selector rotor 101 is spinning in a clockwise direction, documents hitting it will be directed from feed path 91 into the bin 19 associated with that selector rotor 101. The direction of rotation of each selector rotor 101 is made by changing the polarity of the associated D.C. motor 109, and the change in polarity of the D.C. motor 109 is controlled by signals from the computer control apparatus of the document dispenser 11.

The invention overcomes problems created by the complex devices of the prior art by simplifying the direction of travel of the documents 13 such that they either continue being conveyed on the document feed path 91 or are deflected by a selector rotor 101 into a selected bin 19. The rotation of the selector rotor 101 in a clockwise direction sends the document 13 into a selected bin 19, whereas rotation of selector rotor 101 in a counterclockwise direction deflects document 13 so that it continues being conveyed along the document feed path. Such simple in- or out-deflection of document 13 reduces the cost of operation of the document dispenser 11 by correspondingly reducing jam ups which would result from more complex, multi-directional deflection of documents. With this deflection device documents 13 are always in contact with a moving surface as the selector rotor 101 has a surface velocity much greater than document velocity.

FIGS. 2–6 illustrate the operation of document sorter 21. In this illustration, bin 19*c* has been selected as the bin for document 13 to enter. In this illustration, document 13 has been fed to the document dispenser 11 via feeding means 41 to conveyance means 43.

Figure 2:
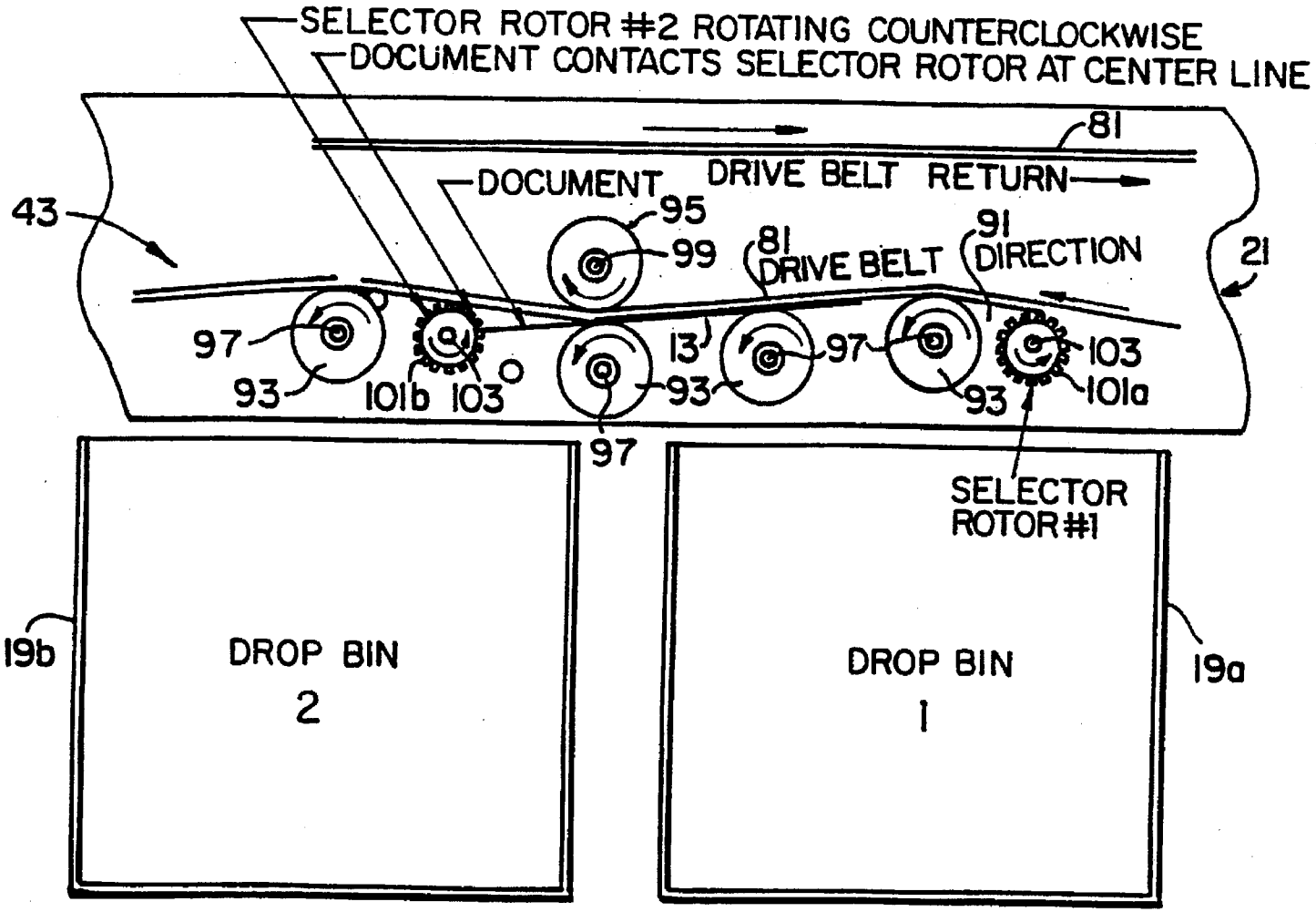
FIGS. 2–6 are partial views in cross section illustrating the sequence of operation of the document sorter of the invention.
Figure 3:
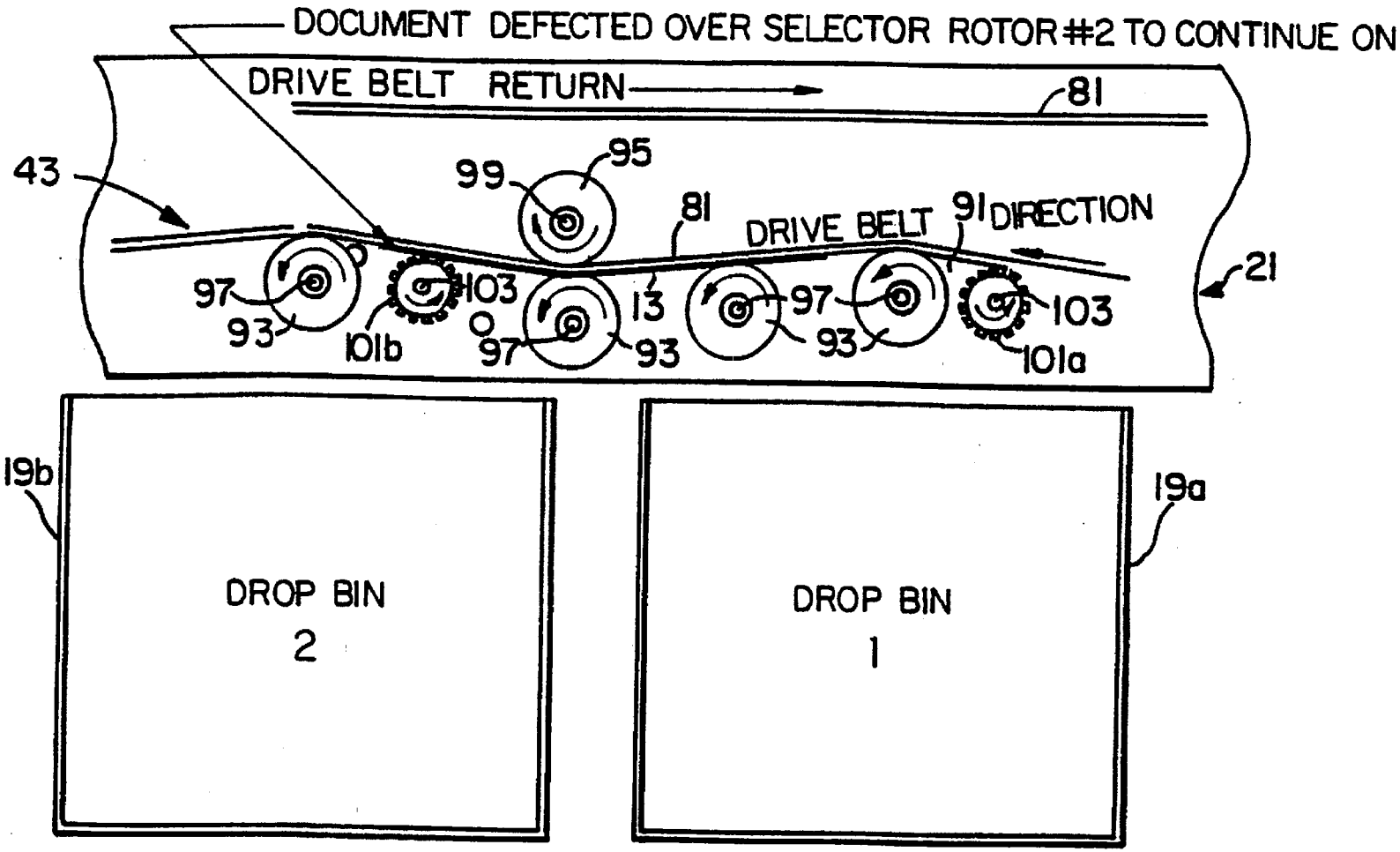

Referring to FIG. 2, document 13 has been conveyed past bin 19*a* because selector rotor 101*a* is spinning counterclockwise. As shown in FIG. 2, document 13 has been conveyed by drive belt 81 along document feed path 91 such that the leading edge of document 13 engages selector rotor 101*b*. Because selector rotor 101*b* is rotating counterclockwise, document 13 is deflected by selector rotor 101*b* over selector rotor 101*b* and continues being conveyed on the document feed path 91 by drive belt 81, as shown in FIG. 3.

Figure 4:
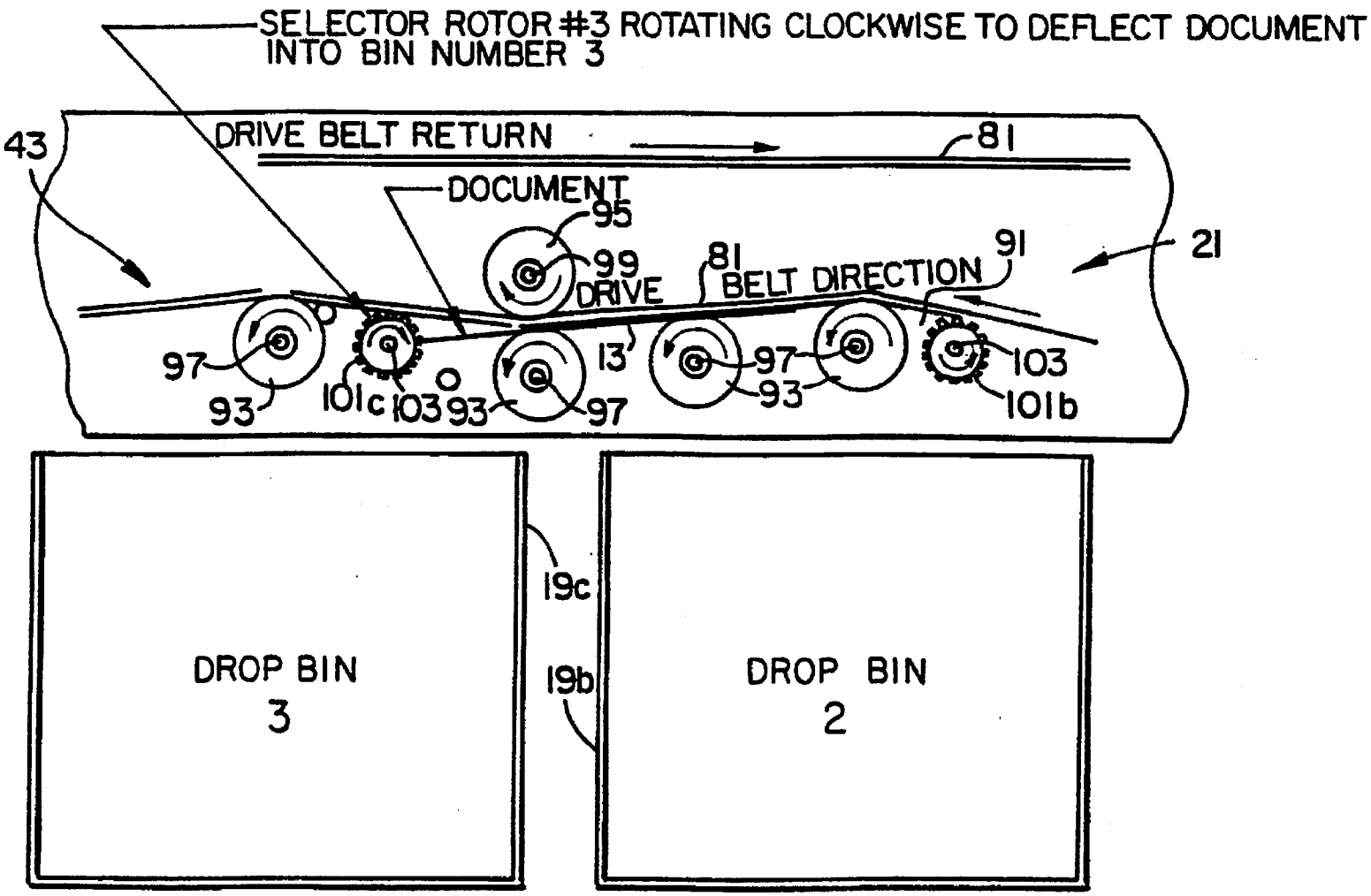

In FIG. 4, document 13 has been conveyed to selector rotor 101*c* where the leading edge of document 13 engages selector rotor 101*c* which is associated with bin 19*c*, the bin that has been selected for the document 13 to be deposited into in this illustration. As shown in FIGS. 5 and 6, the selector rotor 101*c* is rotating clockwise to deflect document 13 into bin 19*c*.

Bin 19*c* may be filled with documents by continuing the process illustrated above, and bins 19*a* and 19*b* may be filled in a similar fashion by sending the appropriate signals from the computer control apparatus to the D.C. motor 109 associated with selector rotors 101*a* and 101*b*. If documents are to be stacked in bin 19*c*, signals from the computer control apparatus are sent to the D.C. motors 109 associated with the selector rotors to cause selector rotor 101*c* to spin clockwise and to cause selector rotors 101*a* and 101*b* to spin counterclockwise. If bin 19*c* is the last bin, as is the case in the illustrative example of the invention shown in the drawings, the associated selector rotor 101*c* is always set to rotate clockwise so that all documents not previously directed to empty into a previous bin 19*a* or 19*b* empty into the last bin 19*c*.

If it is desired to deposit a document 13 into bin 19*b*, a signal may be sent from the computer control apparatus to D.C. motor 109 associated with selector 101*b* to change the polarity of the D.C. motor 109 causing selector rotor 101*b* to rotate clockwise causing documents 13 that hit it to be deflected downwardly into the associated bin 19*b*.

If it is desired to deposit a document 13 into bin 19*a*, a signal may be sent from the computer control apparatus to D.C. motor 109 associated with selector 101*a* to change the polarity of the D.C. motor 109 causing selector rotor 101*a* to rotate clockwise causing documents 13 that hit it to be downwardly into the associated bin 19*a*.

Referring to FIG. 5, when a document 13 reaches the position shown in FIG. 5, the direction of rotation of the selector rotor 101 may be reversed, that is, it may be changed from clockwise rotation to counterclockwise rotation, without interfering with the entrance of the document 13 into the bin 19. This makes bin selection timings less critical and also makes it possible for higher drive belt velocities, thereby increasing the throughput of the system.

A benefit of the invention is that the trailing edge of a document 13 (see FIG. 6) and the leading edge of a document 13 (see FIG. 2) are going in different directions by 20°, thereby avoiding trailing/leading edge collisions because the leading document has moved down into the bin. With this deflection device documents 13 are always in contact with a moving surface as the selector rotor 101 has a surface velocity much greater than document velocity.

Another benefit of the invention is that the documents 13 collide with a rotating selector rotor 101, rather than a stationary deflector, thereby avoiding slowing down of the documents when they engage a selector rotor 101 and avoiding a first document 13 being caught by a trailing document 13.

Another benefit of the invention is that the documents 13 are conveyed in a simple in- or out-manner with a rotating selector rotor 101, namely, documents 13 either continue being conveyed on the document feed path 91 by counterclockwise rotation of an encountered selector rotor 101 or are deflected by clockwise rotation of an encountered selector rotor 101 into a selected bin 19. This simple arrangement decreases operational costs associated with jamming of the document dispenser 11, which would otherwise result with a more complex, multi-directional document deflection.

The revolutions per minute of each selector rotor 101 to the ratio of inches per second of the drive belt 81 are not critical. Preferably, 1000 to 2000 rpm of 0.50 inch diameter selector rotor 101 to the ratio of 25 inches/second drive belt velocity is used. However, other ratios are possible.

In summary, the computer control apparatus controls the rotation of selector rotors 101 via signals from the computer control apparatus to the D.C. motors 109 associated with each selector rotor 101. If it is desired to bypass a bin 19, the selector rotor 101 associated with the bypassed bin 19 is directed to spin counterclockwise so that the documents 13 hitting it are deflected over that selector rotor 101 to continue movement along document feed path 91. To have documents 13 deposited in a specific bin 19, the computer control apparatus sends a signal to the D.C. motor 109 associated with the specific bin 19 to cause the selector rotor 101 associated with the specific bin 19 to rotate clockwise causing the documents 13 hitting it to deflect into the selected bin 19.

As shown in FIGS. 2–6, the documents 13 are always pressed against drive belt 81 by idler wheels 93 while the documents are on the document feed path 91, thereby avoiding any free flight of the document 13 while it is on the document feed path 91.

Once documents 13 have been deposited in bins 19, the documents may be conveyed as desired from the bins 19 to the stacker means 23 using the stacker feeder means 25 as discussed in detail in Cargill et al. U.S. Pat. No. 4,691,910, which has been incorporated herein by reference.

ADVANTAGES

The sorting feed mechanism of the present invention eliminates the need for a person refilling an automatic document dispensing machine to have access to the entire contents of that machine.

Further, because the documents being sorted do not touch any stationary parts along the path to the bins, the sorter may be operated at a high speed without misfeeding documents or jamming.

We claim:

1. A document sorter for a document dispenser comprising feeding means for feeding documents to a substantially horizontal document feed path, conveyance means mounted along the document feed path for conveying documents along the document feed path, said conveyance means including a drive belt (81) having a lower run that extends horizontally along a document feed path (91), said drive belt lower run having an upper surface and a lower surface, a plurality of upper idler wheel means (95) positioned along the document feed path (91) in contact with the upper surface of the lower run of the drive belt (81) for holding the belt taut, a plurality of lower idler wheel means (93) being positioned below the drive belt (81) for pressing each document (13) upwardly against the lower run of the drive belt as each document moves along the document feed path (91), said lower idler wheel means (93) being spaced apart so that each document (13) is never in free flight along the document feed path (91) until the document (13) reaches a bin that has been selected for deposit of the document, said upper idler wheel means (95) being positioned above the lower run of the drive belt (81) to provide tautness to drive belt (81) to ensure contact between drive belt (81) and the wheel means (93) , directing means mounted across the document feed path at a 90° angle to the feed path for selectively directing documents substantially horizontally along the feed path or for selectively directing documents downwardly away from the feed path, said directing means including a plurality of rotatable selector rotor means including a selector rotor mounted across the document feed path at a 90° angle to the document feed path for selectively directing documents (13) along the document feed path (91) or for selectively directing documents from the document feed path (91), each of the selector rotors continuously rotating, except to stop when its direction of rotation is reversed, for either selectively directing, contacting and moving documents substantially horizontally along the document feed path by contacting the documents while rotating in one direction or selectively directing documents downwardly away from the feed path by contacting the documents while rotating in the other direction, each of the selective rotors having a midsection, said idler wheel means (93, 95) being located just before each selector rotor in position to direct the leading edges of the document (13) to the midsection of the selector rotor and being close enough to the selector rotor that the document (13) is still supported.

and motor means for driving each selector rotor and for selectively controlling the direction of rotation of each selector rotor.

2. The document sorter of claim 1, each selector rotor means including a rotor having a circular cross-section.

3. The document sorter of claim 1, each selector rotor means including a rotor having a surface having grooves formed therein, said grooves extending in a direction parallel to the rotational axis of the selector rotor.

4. The document sorter of claim 1, each selector rotor means including a rotor having a gear-shaped cross section.

5. The document sorter of claim 1, each selector rotor means including a rotor having a surface made of foam rubber.

6. The document sorter of claim 1, the motor means including a separate D.C. motor connected to each rotatable selector rotor, wherein the D.C. motor drives the rotatable selector rotor and a change in polarity of the D.C. motor changes the direction of rotation of the rotatable selector rotor.

7. A document sorter for a document dispenser comprising feeding means for feeding documents to a substantially horizontal document feed path, conveyance means mounted along the document feed path for conveying documents along the document feed path, said conveyance means including a drive belt (81) having a lower run that extends horizontally along a document feed path (91), said drive belt lower run having an upper surface and a lower surface, a plurality of upper idler wheel means (95) positioned along the document feed path (91) in contact with the upper surface of the lower run of the drive belt (81) for holding the belt taut, a plurality of lower idler wheel means (93) being positioned below the drive belt (81) for pressing each document (13) upwardly against the lower run of the drive belt as each document moves along the document feed path (91), said lower idler wheel means (93) being spaced apart so that each document (13) is never in free flight along the document feed path (91) until the document (13) reaches a bin that has been selected for deposit of the document, said upper idler wheel means (95) being positioned above the drive belt (81) to provide tautness to drive belt (81) to ensure contact between drive belt (81) and the wheel means (93), directing means mounted across the document feed path at a 90° angle to the feed path for selectively directing, contacting, and moving documents substantially horizontally along the feed path or for selectively directing documents downwardly away from the feed path, said directing means including a plurality of rotatable selector rotor means including a selector rotor mounted across the document feed path for selectively directing documents (13) along the document feed path (91) or for selectively directing from the document feed path (91), at a 90° angle to the document feed path, each of the selector rotors continuously rotating, except to stop when its direction of rotation is reversed, for either selectively directing and moving documents substantially horizontally along the document feed path by contacting the documents while rotating in one direction or selectively directing documents downwardly away from the feed path by contacting the documents while rotating in the other direction, and each of the selective rotors having a midsection, said idler wheel means (93, 95) being located just before each selector rotor in position to direct the leading edges of the document (13) to the midsection of the selector rotor and being close enough to the selector rotor that the document (13) is still supported, motor means for driving each selector rotor means and for selectively controlling the direction of rotation of each selector rotor means, each selector rotor having a circular cross section, the surface of each selector rotor being made of foam rubber, and the motor means including a separate D.C. motor connected to each rotatable selector rotor, wherein the D.C. motor drives the rotatable selector rotor and a change in polarity of the D.C. motor changes the direction of rotation of the rotatable selector rotor.

8. A document dispenser for dispensing documents from a plurality of stacks of documents, comprising a frame, stacker means mounted on the frame for receiving successively fed documents and stacking them, a plurality of bins mounted on the frame for holding respective stacks of documents, stacker feeding means associated with each bin and mounted on the frame for feeding documents from the bins to the stacker means and including document feeding and separating means for feeding documents from each bin so they move individually in a successive condition from each bin, document acceleration means associated with each document feeding and separating means and mounted on the frame for providing a space between the successively fed documents, and document delivery means mounted on the frame for feeding the spaced apart documents to the stacker means, and a document sorter, said document sorter comprising feeding means for feeding documents to a substantially horizontal document feed path, conveyance means mounted along the document feed path for conveying documents along the document feed path, directing means mounted across the document feed path at a 90° angle to the feed path for selectively directing documents substantially horizontally along the feed path or for selectively directing and moving documents downwardly away from the feed path into a selected bin, said directing means including a plurality of rotatable selector rotors mounted across the document feed path at a 90° angle to the document feed path, each of the selector rotors continuously rotating, except to stop when its direction of rotation is reversed, for either selectively directing documents substantially horizontally along the document feed path by contacting the documents while rotating in one direction or selectively directing documents downwardly away from the feed path by contacting the documents while rotating in the other direction, and motor means for driving each selector rotor and for selectively controlling the direction of rotation of each selector rotor, a plurality of idler wheels (93, 95) including a first Lower (93) and a second upper (95) set of idler wheels, the first lower set of idler wheels (93) being positioned below the drive belt (81) and in contact with it, the wheels of the second upper set (95) of idler wheels being spaced apart from each other in a longitudinal direction of the drive belt (81) such that each of the documents always has at least some portion thereof which is positioned between one of the wheels of the first lower set (93) of idler wheels and the drive belt (81) while the document is traveling along the document feed path, the second upper set (95) of idler wheels being positioned above the drive belt (81) and in contact with it for providing tautness to the drive belt (81) for insuring contact between the drive belt (81) and the first lower set (93) of idler wheels.

9. The document dispenser of claim 8, each selector rotor having a circular cross-section.

10. The document dispenser of claim 8, each selector rotor having a surface having grooves formed therein, said grooves extending in a direction parallel to the axis of the selector rotor.

11. The document dispenser of claim 8, each selector rotor having a gear-shaped cross-section.

12. The document dispenser of claim 8, each selector rotor having a surface made of foam rubber.

13. The document dispenser of claim 8, the motor means including a separate D.C. motor connected to each rotatable selector rotor, wherein the D.C. motor drives the rotatable selector rotor and a change in polarity of the D.C. motor changes the direction of rotation of the rotatable selector rotor.

14. A document dispenser for dispensing documents from a plurality of stacks of documents, comprising a frame, stacker means mounted on the frame for receiving successively fed documents and stacking them, a plurality of bins mounted on the frame for holding respective stacks of documents, stacker feeding means associated with each bin and mounted on the frame for feeding documents from the bins to the stacker means and including document feeding and separating means for feeding documents from each bin so they move individually in a successive condition from each bin, document acceleration means associated with each document feeding and separating means and mounted on the frame for providing a space between the successively fed documents, and document delivery means mounted on the frame for feeding the spaced apart documents to the stacker means, and a document sorter, said document sorter comprising feeding means for feeding documents to a substantially horizontal document feed path, conveyance means mounted along the document feed path for conveying documents along the document feed path, directing means mounted across the document feed path at a 90° angle to the feed path for selectively directing documents substantially horizontally along the feed path or for selectively directing documents downwardly from the feed path into a selected bin, said directing means including a plurality of rotatable selector rotors mounted across the document feed path at a 90° angle to the document feed path, each of the selector rotors continuously rotating, except to stop when its direction of rotation is reversed, for either selectively directing and moving documents substantially horizontally along the document feed path by contacting the documents While rotating in one direction or selectively directing documents downwardly away from the feed path by contacting the documents while rotating in the other direction, and motor means for driving each selector rotor and for selectively controlling the direction of rotation of each selector rotor, the conveyance means including a drive belt extending along the document feed path, and a plurality of idler wheels positioned along the document feed path in contact with the drive belt, each selector rotor having a circular cross section, each selector rotor having a surface made of foam rubber, and the motor means including a separate D.C. motor connected to each rotatable selector rotor, wherein the D.C. motor drives the rotatable selector rotor and a change in polarity of the D.C. motor changes the direction of rotation of the rotatable selector rotor, the plurality of idler wheels (93, 95) including a first lower (93) and a second upper (95) set of idler wheels, the first lower set (93) of idler wheels being positioned below the drive belt (81) and in contact with it, the wheels of the first lower set (93) of idler wheels being spaced apart from each other in a longitudinal direction of the drive belt (81) such that each of the documents always has at least some portion thereof which is positioned between one of the wheels of the first lower set (93) of idler wheels and the drive belt (81) while the document is traveling along the document feed path, the second upper set (95) of idler wheels being positioned above the drive belt (81) and in contact with it for providing tautness to the drive belt (81) for insuring contact between the drive belt (81) and the first lower set (93) of idler wheels.

15. The document dispenser of claim 14, each selector rotor being gear-shaped in cross-section.

16. A document sorter for a document dispenser comprising feeding means for feeding documents to a substantially horizontal document feed path, conveyance means mounted along the document feed path for conveying documents along the document feed path, directing means mounted across the document feed path at a 90° angle to the feed path for selectively directing documents substantially horizontally along the feed path or for selectively directing documents downwardly away from the feed path, said directing means including a plurality of rotatable selector rotors mounted across the document feed path at a 90° angle to the document feed path, each of the selector rotors continuously rotating, except to stop when its direction of rotation is reversed, for either selectively directing documents substantially horizontally along the document feed path by contacting the documents while rotating in one direction or selectively directing documents downwardly away from the feed path by contacting the documents while rotating in the other direction, and motor means for driving each selector rotor and for selectively controlling the direction of rotation of each selector rotor, the conveyance means including a drive belt extending along the document feed path, and a plurality of idler wheels positioned along the document feed path in contact with the drive belt, the plurality of idler wheels including a first and a second set of idler wheels, the first set of idler wheels being positioned below the drive belt and in contact with it, the wheels of the first set of idler wheels being spaced apart from each other in a longitudinal direction of the drive belt such that each of the documents always has at least some portion thereof which is positioned between one of the wheels of the first set of idler wheels and the drive belt while the document is traveling along the document feed path, the second set of idler wheels being positioned above the drive belt and in contact with it for providing tautness to the drive belt for insuring contact between the drive belt and the first set of idler wheels.

17. A document dispenser for dispensing documents from a plurality of stacks of documents, comprising a frame, stacker means mounted on the frame for receiving successively fed documents and stacking them, a plurality of bins mounted on the frame for holding respective stacks of documents, stacker feeding means associated with each bin and mounted on the frame for feeding documents from the bins to the stacker means and including document feeding and separating means for feeding documents from each bin so they move individually in a successive condition from each bin, document acceleration means associated with each document feeding and separating means and mounted on the frame for providing a space between the successively fed documents, and document delivery means mounted on the frame for feeding the spaced apart documents to the stacker means, and a document sorter, said document sorter comprising feeding means for feeding documents to a substantially horizontal document feed path, conveyance means mounted along the document feed path for conveying documents along the document feed path, directing means mounted across the document feed path at a 90° angle to the feed path for selectively directing documents substantially horizontally along the feed path or for selectively directing documents downwardly away from the feed path into a selected bin, said directing means including a plurality of rotatable selector rotors mounted across the document feed path at a 90° angle to the document feed path, each of the selector rotors continuously rotating, except to stop when its direction of rotation is reversed, for either selectively directing documents substantially horizontally along the document feed path by contacting the documents while rotating in one direction or selectively directing documents downwardly away from the feed path by contacting the documents while rotating in the other direction, and motor means for driving each selector rotor and for selectively controlling the direction of rotation of each selector rotor, the conveyance means including a drive belt extending along the document feed path, and a plurality of idler wheels positioned along the document feed path in contact with the drive belt, the plurality of idler wheels including a first and a second set of idler wheels, the first set of idler wheels being positioned below the drive belt and in contact with it, the wheels of the first set of idler wheels being spaced apart from each other in a longitudinal direction of the drive belt such that each of the documents always has at least some portion thereof which is positioned between one of the wheels of the first set of idler wheels and the drive belt while the document is traveling along the document feed path, the second set of idler wheels being positioned above the drive belt and in contact with it for providing tautness to the drive belt for insuring contact between the drive belt and the first set of idler wheels.

18. A document sorter for a document dispenser comprising feeding means for feeding documents to a substantially horizontal document feed path, conveyance means mounted along the document feed path for conveying documents along the document feed path, directing means mounted across the document feed path at a 90° angle to the feed path for selectively directing documents substantially horizontally along the feed path or for selectively directing documents downwardly away from the feed path, said directing means including a plurality of rotatable selector rotors mounted across the document feed path at a 90° angle to the document feed path, each of the selector rotors continuously rotating, except to stop when its direction of rotation is reversed, for either selectively directing documents substantially horizontally along the document feed path by contacting the documents while rotating in one direction or selectively directing documents downwardly away from the feed path by contacting the documents while rotating in the other direction, and motor means for driving each selector rotor and for selectively controlling the direction of rotation of each selector rotor, the conveyance means including a drive belt extending along the document feed path, and a plurality of idler wheels positioned along the document feed path in contact with the drive belt, the plurality of idler wheels including a first and a second set of idler wheels, the first set of idler wheels being positioned below the drive belt and in contact with it, the wheels of the first set of idler wheels being spaced apart from each other in a longitudinal direction Of the drive belt such that each of the documents always has at least some portion thereof which is positioned between one of the wheels of the first set of idler wheels and the drive belt while the document is traveling along the document feed path, the second set of idler wheels being positioned above the drive belt and in contact with it for providing tautness to the drive belt for insuring contact between the drive belt and the first set of idler wheels.

19. A document dispenser for dispensing documents from a plurality of stacks of documents, comprising a frame, stacker means mounted on the frame for receiving successively fed documents and stacking them, a plurality of bins mounted on the frame for holding respective stacks of documents, stacker feeding means associated with each bin and mounted on the frame for feeding documents from the bins to the stacker means and including document feeding and separating means for feeding documents from each bin so they move individually in a successive condition from each bin, document acceleration means associated with each document feeding and separating means and mounted on the frame for providing a space between the successively fed documents, and document delivery means mounted on the frame for feeding the spaced apart documents to the stacker means, and a document sorter, said document sorter comprising feeding means for feeding documents to a substantially horizontal document feed path, conveyance means mounted along the document feed path for conveying documents along the document feed path, directing means mounted across the document feed path at a 90° angle to the feed path for selectively directing documents substantially horizontally along the feed path or for selectively directing documents downwardly away from the feed path into a selected bin, said directing means including a plurality of rotatable selector rotors mounted across the document feed path at a 90° angle to the document feed path, each of the selector rotors continuously rotating, except to stop when its direction of rotation is reversed, for either selectively directing documents substantially horizontally along the document feed path by contacting the documents while rotating in one direction or selectively directing documents downwardly away from the feed path by contacting the documents while rotating in the other direction, and motor means for driving each selector rotor and for selectively controlling the direction of rotation of each selector rotor, the conveyance means including a drive belt extending along the document feed path, and a plurality of idler wheels positioned along the document feed path in contact with the drive belt, the plurality of idler wheels including a first and a second set of idler wheels, the first set of idler wheels being positioned below the drive belt and in contact with it, the wheels of the first set of idler wheels being spaced apart from each other in a longitudinal direction of the drive belt such that each of the documents always has at least some portion thereof which is positioned between one of the wheels of the first set of idler wheels and the drive belt while the document is traveling along the document feed path, the second set of idler wheels being positioned above the drive belt and in contact with it for providing tautness to the drive belt for insuring contact between the drive belt and the first set of idler wheels.

* * * * *